US009018933B2

(12) United States Patent
Hung et al.

(10) Patent No.: US 9,018,933 B2
(45) Date of Patent: Apr. 28, 2015

(54) VOLTAGE BUFFER APPARATUS

(75) Inventors: Chun-Hsiung Hung, Hsinchu (TW); Ju-An Chiang, Hsinchu (TW)

(73) Assignee: Macronix International Co., Ltd. (TW)

( * ) Notice: Subject to any disclaimer, the term of this patent is extended or adjusted under 35 U.S.C. 154(b) by 206 days.

(21) Appl. No.: 13/553,329

(22) Filed: Jul. 19, 2012

(65) Prior Publication Data

US 2014/0021935 A1 Jan. 23, 2014

(51) Int. Cl.
*G05F 3/16* (2006.01)
*G05F 1/56* (2006.01)

(52) U.S. Cl.
CPC ..... *G05F 1/56* (2013.01)

(58) Field of Classification Search
None
See application file for complete search history.

(56) References Cited

U.S. PATENT DOCUMENTS 5,545,978 A * 8/1996 Pontius ..... 323/313
5,563,501 A * 10/1996 Chan ..... 323/282
6,201,379 B1 * 3/2001 MacQuigg et al. ..... 323/313
6,215,291 B1 * 4/2001 Mercer ..... 323/313
7,109,758 B2 * 9/2006 Lin ..... 326/112
7,852,061 B2 12/2010 Liu et al.
8,633,681 B2 * 1/2014 Chu ..... 323/271
2007/0252573 A1 * 11/2007 Tachibana et al. ..... 323/313
2009/0257289 A1 * 10/2009 Byeon ..... 365/189.09
2013/0147448 A1 * 6/2013 Kadanka ..... 323/280
2013/0320944 A1 * 12/2013 Siao ..... 323/282

FOREIGN PATENT DOCUMENTS

CN 101419477 A 4/2009
CN 101995900 A 3/2010
TW 201003357 A 1/2010

OTHER PUBLICATIONS

Office Action mailed in corresponding Taiwanese Patent Application No. 101124801 on Aug. 6, 2014, consisting of 7 pp. (English Translation of Search Report Provided).

* cited by examiner

*Primary Examiner* — Timothy J Dole
*Assistant Examiner* — Monica Mata
(74) *Attorney, Agent, or Firm* — Volpe and Koenig, P.C.

(57) ABSTRACT

The present invention relates to a voltage bandgap buffer apparatus. This apparatus includes a voltage processing module to produce a bandgap buffer voltage in response to an input voltage and a feedback signal and a symmetry circuit. This symmetry circuit is coupled to the voltage processing module for producing the feedback signal and for regulating the feedback signal in response to the input voltage.

16 Claims, 3 Drawing Sheets

VOLTAGE BUFFER APPARATUS

FIELD OF THE INVENTION

The present invention relates to a voltage buffer apparatus for a low voltage bandgap circuit, in particular an apparatus for providing chips with a stabilized voltage source unaffected by changes in temperature and environment by using a transistor complementary switch.

BACKGROUND OF THE INVENTION

The well known low voltage bandgap buffer apparatus is an indispensable part in a bandgap system. In practice, this apparatus can compensate for the voltage variation of a bandgap circuit which has the advantage of promoting a circuit system architecture design that uses a transistor with a low operational voltage. However, it is more and more difficult to design this buffer in a low voltage environment, especially when there is no low threshold (low $V_t$) device available.

In the other aspect, the purpose of providing a stabilized voltage source to a circuit without subjecting it to temperature fluctuations, other voltages, and environmental changes is conformed with the requirements of electrical characteristics of transistor hardware from the circuit design software point of view, such as field-programmable gate arrays (FPGA) and application-specific integrated circuits (ASIC). Therefore based on the trend of transistor sizes becoming miniaturized, this voltage buffer apparatus having the capabilities of stabilizing the voltage source and providing applications for high-level circuits needs to be further improved to promote its key role in the circuit system design.

Please refer to FIG. 1, in a conventional voltage buffer apparatus which contains a voltage source 105 and a ground 106, an input signal 101 is magnified with the first degree from an operational amplifier 10 and then with the second degree from a transistor 11 which is connected to the output terminal 103 of the operational amplifier 10 for providing a stabilized output voltage 104 to the next circuit stage, wherein the variation factor of the input signal 101 can be compensated with the modulation of a feedback voltage 102 which is subject to a first variable resistor 12. Yet the feedback voltage 102 can not be transmitted by using MOSFET in the condition of low voltage, it is to say that the feedback route is not capable to proceed useful compensation within this architecture.

In the other hand, the changing method of the first variable resistor 12 is having different values of resistors in the upper section and lower section with respect to the feedback node such that the feedback voltage 102 is high when an adjusting switch 13 being located on the first position 131 and is low when the adjusting switch 13 being located on the second position 132. However it is not satisfied with the demand of a simplified device value changing when performing voltage adjustment in the circuit architecture with above mentioned method for the requirement of analysis and control of the circuit operation. Therefore it is necessary to do some improvements in the architecture of the voltage buffer apparatus for fulfilling the goals of electrical characteristic match and reliable operation of the device in the prevalent usage of the voltage buffer apparatus for bandgap system.

From above mentioned, a new voltage buffer apparatus for bandgap system is needed urgently. Thus, based on the drawbacks of prior art, the inventor gave the utmost attention and finally invented the voltage buffer apparatus for bandgap system with experiment and research. Based on the spirit to work with perseverance, the problem of prior art was solved.

The particular design in the present invention not only solves the problems described above, but also is easy to be implemented. Thus, the invention has the utility for the industry.

SUMMARY OF THE INVENTION

For conquering the defects existed in the prior art, the invention provides a voltage buffer apparatus, wherein the transmission capability of the voltage buffer in the bandgap system is more effective by combing the techniques of MOSFET signal processing and operational amplifier feedback. This system architecture has not only reliable voltage transmission efficiency with integrity, it can also support the stabling voltage process with any low bandgap voltage and allow the feedback linkage of the operational amplifier to effectively compensate the input signal for providing a reliable signal supply in bandgap core structure.

According to above thought, a bandgap buffer for providing a bandgap buffer voltage to a chip, comprising: an operational amplifier having an output terminal, a first input terminal, and a second input terminal receiving an input voltage; a first transistor having a control terminal connected to the output terminal and a first terminal connected to the chip power source so as to provide the bandgap buffer voltage; and a switching array including: (N+1) first resistors connected in series, each of which has a first and a second terminals, where N is a positive integer; a second resistor having a first and a second terminals; a third resistor having a first and a second terminals; (N+1) fourth resistors connected in series, each of which has a first and a second terminals; a first switching subarray with (N+1) second transistors, each of which has a first and a second terminals, wherein all the second terminals of the (N+1) second transistors and the second terminal of the (N+1)th one of the (N+1) first resistors are connected to the first terminal of the first transistor, the first terminal of the mth second transistor is connected to the first terminal of the mth one of the (N+1) first resistors, where m=1 . . . N+1, the first terminal of the second resistor is connected to the first input terminal of the operational amplifier, the second terminal of the second resistor is connected to the first terminal of the first one of the (N+1) first resistors, and the second terminal of the third resistor is connected to the first terminal of the second resistor; and a second switching subarray with (N+1) third transistors, each of which has a first terminal, and a second terminal connected to a ground, wherein the first terminal of the last one of the (N+1) third transistors is connected to the first terminal of the third resistor, and the first terminal of the mth one of the (N+1) third transistors is connected to the second terminal of the mth one of the (N+1) fourth resistors.

Preferably, the present invention which addresses a bandgap buffer, wherein the first transistor further comprises a second terminal receiving a power supply voltage, each of the (N+1) second transistors and the (N+1) third transistors further has a control terminal receiving an external control signal.

Preferably, the present invention which addresses a bandgap buffer, wherein the first transistor and each of the (N+1) second transistors are a P-type transistor and each of the (N+1) third transistors is an N-type transistor.

According to above thought, a bandgap buffer for providing a bandgap buffer voltage to a chip, comprising: a voltage adjusting module receiving an input voltage and a feedback signal, and regulating the input voltage according to the feedback signal so as to produce the bandgap buffer voltage; and a switching array coupled to the voltage adjusting module, and including a plurality of complementary switch sets, each of which has two complementary switches with two respective control terminals receiving two respective external control signals to enable a specific one of the plurality of complementary switch sets according to a reference range of the input voltage such that the enabled complementary switch set produces the feedback signal.

Preferably, the present invention which addresses a bandgap buffer, wherein the voltage adjusting module further comprises: an operational amplifier having an output terminal; and a first transistor having a control terminal connected to the output terminal.

Preferably, the present invention which addresses a bandgap buffer, wherein the switching array further comprises a first subarray with (N+1) P-type transistors and a second subarray with (N+1) N-type transistors.

Preferably, the present invention which addresses a bandgap buffer, wherein the switching array further comprises: (N+1) first resistors connected in series, each of which has a first and a second terminals, where N is a positive integer; a second resistor having a first and a second terminals; a third resistor having a first and a second terminals; and (N+1) fourth resistors connected in series, each of which has a first and a second terminals, the first transistor has a first terminal connected to the output terminal, each of the (N+1) P-type transistors has a first and a second terminals, all the second terminals of the (N+1) P-type transistors and the second terminal of the (N+1)th one of the (N+1) first resistors are connected to the first terminal of the first transistor, the first terminal of the mth one of the (n+1) P-type transistors is connected to the first terminal of the mth one of the (N+1) first resistors, where m=1 . . . N+1, the first terminal of the second resistor is connected to the first input terminal of the operational amplifier, the second terminal of the second resistor is connected to the first terminal of the first one of the (N+1) first resistors, the second terminal of the third resistor is connected to the first terminal of the second resistor, each of the (N+1) N-type transistors has a first terminal, and a second terminal connected to a ground, the first terminal of the last one of the (N+1) N-type transistors is connected to the first terminal of the third resistor, and the first terminal of the mth one of the (N+1) N-type transistors is connected to the second terminal of the mth one of the (N+1) fourth resistors.

Preferably, the present invention which addresses a bandgap buffer, wherein every complementary switch set comprises a P-type transistor and an N-type transistor.

According to above thought, a bandgap buffer, comprising: a voltage processing module producing a bandgap buffer voltage in response to an input voltage and a feedback signal; and a symmetry circuit coupled to the voltage processing module, producing the feedback signal and regulating the feedback signal in response to the input voltage.

Preferably, the present invention which addresses a bandgap buffer, wherein the voltage processing module includes: an operational amplifier having an output terminal; and a first transistor having a first terminal, and a control terminal connected to the output terminal; wherein the symmetry circuit further comprises: a first subarray having plural P-type transistors, each of which has a first terminal connected to the first terminal of the first transistor; and a second subarray having plural N-type transistors, each of which has a first terminal connected to the ground and a second terminal coupled to a second terminal of the first transistor.

Preferably, the present invention which addresses a bandgap buffer, wherein a specific one of the plural P-type transistors is turned on for providing a first resistance, and another specific one of the plural N-type transistors of the second subarray is turned on for providing a second resistance, where both transistors are turned on in a complementary manner.

Preferably, the present invention which addresses a bandgap buffer, wherein a sum of the first resistance and the second resistance is fixed though there are individual variations in the values of the first and the second resistances.

Preferably, the present invention which addresses a bandgap buffer, further comprising a common source stage, wherein the second resistance is in variation with the input voltage that causes a constant current of the common source stage.

Preferably, the present invention which addresses a bandgap buffer, wherein each of the plural P-type transistors is a P-type MOSFET, and the bandgap buffer voltage is bigger than a threshold voltage of the P-type MOSFET.

Preferably, the present invention which addresses a bandgap buffer, wherein the operational amplifier further includes two input terminals, the feedback signal has a variation range of ±150 mV.

Preferably, the present invention which addresses a bandgap buffer, wherein the bandgap buffer voltage is constant.

The present invention may best be understood through the following descriptions with reference to the accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purposes of illustration and description only; it is not intended to be exhaustive or to be limited to the precise form disclosed.

Figure 1:
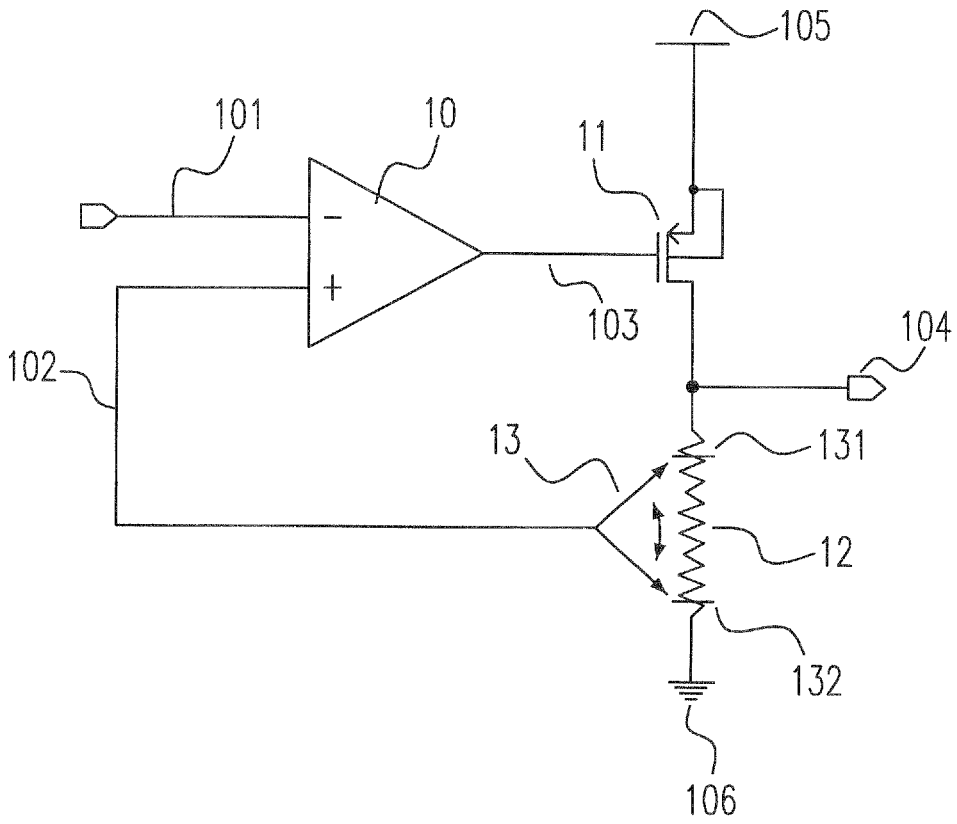
FIG. 1 is a diagram of a traditional voltage buffer apparatus.
Figure 2:
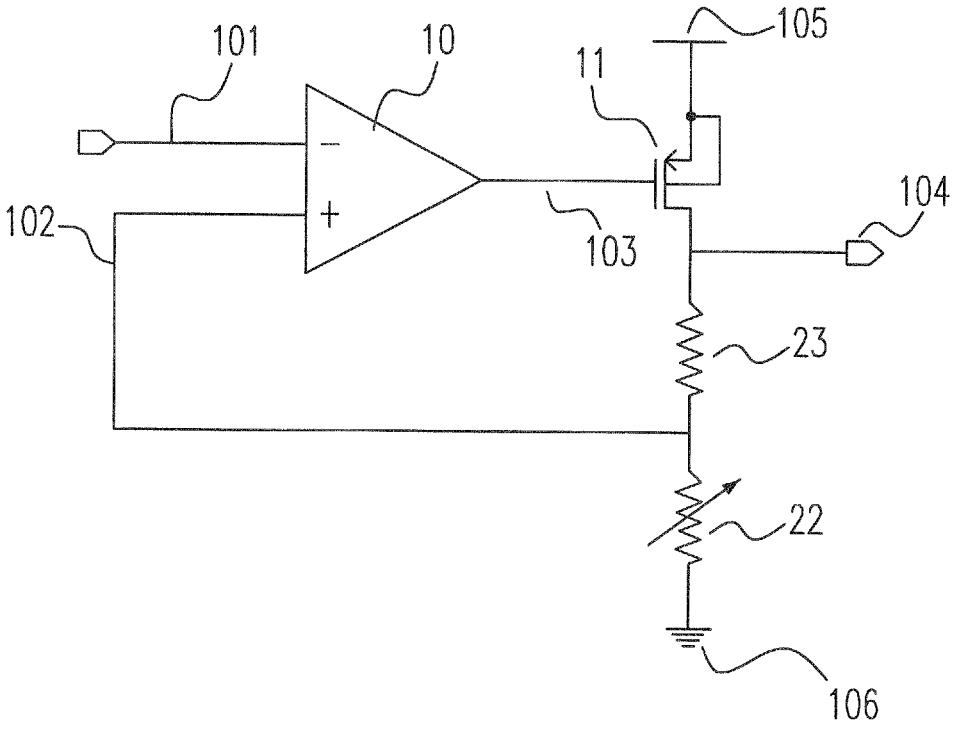
FIG. 2 is a diagram of a voltage buffer apparatus with a variable resistor connected to ground according to the first embodiment of the present invention.

Please refer to FIG. 2 which is the first embodiment. The voltage buffer apparatus of the present invention has a second variable resistor 22 connected to ground where the input signal 101 (bandgap core voltage) is a variable 1 volt. And two input signals of the input end of the operational amplifier 10, i.e. the input signal 101 and the feedback voltage 102, should be presenting as a virtual short, wherein a constant resistor 23 is in serial connection with the second variable resistor 22. A trim up/down phenomenon has come into being due to the magnitude of the feedback voltage 102 being following that of the input signal 101 resulted from the changing value of the second variable resistor 22. It is to say that the appearance of the input signal 101 variation will be eliminated through the amplification effect of the voltage buffer apparatus.

The trim up/down is accomplished by adjusting the second variable resistor 22 which is achieved by shorting n-channel MOSFET to ground through enabling its gate. Therefore, high threshold voltage (Vt) at low voltage operation is eliminated. At the same time, the level of the output voltage 104 has to be higher than the input signal 101 (target trim voltage) which is comparable to the feedback voltage 102, wherein the feedback voltage 102 comes from a feedback node being always at the lower side of the output node.

During the time, the output voltage 104 is set to 1.25 volts and the current of the feedback linkage is scheduled to 1μ Ampere. If the second variable resistor 22 being taken as 1000K ohms and the constant resistor 23 being taken as 250K ohms, in order that the feedback voltage 102 can follow the input signal 101, the second variable resistor 22 is calculated as 530K ohms and the current of the feedback linkage is obtained as 1.6μ Ampere (0.85V/510K) when the input signal 101 being as 1V-150 mV (where V=Volt), whereas the calculated second variable resistor 22 being as 2880K ohms and the current of the feedback linkage being obtained as 0.4μ Ampere (1.15V/2880K) which is only one-fourth of the above current of the feedback linkage when the input signal 101 being as 1V+150 mV. Additionally, the total resistor being as 3130K ohms (250K+2880K) in this case has a much larger size than that of conventional architecture with resistor being as 1250K ohms (250K+1000K). Hence the appearance of above large current variation and the condition of high resistor magnitude should be considered carefully in the design of common-source output stage.

Figure 3:
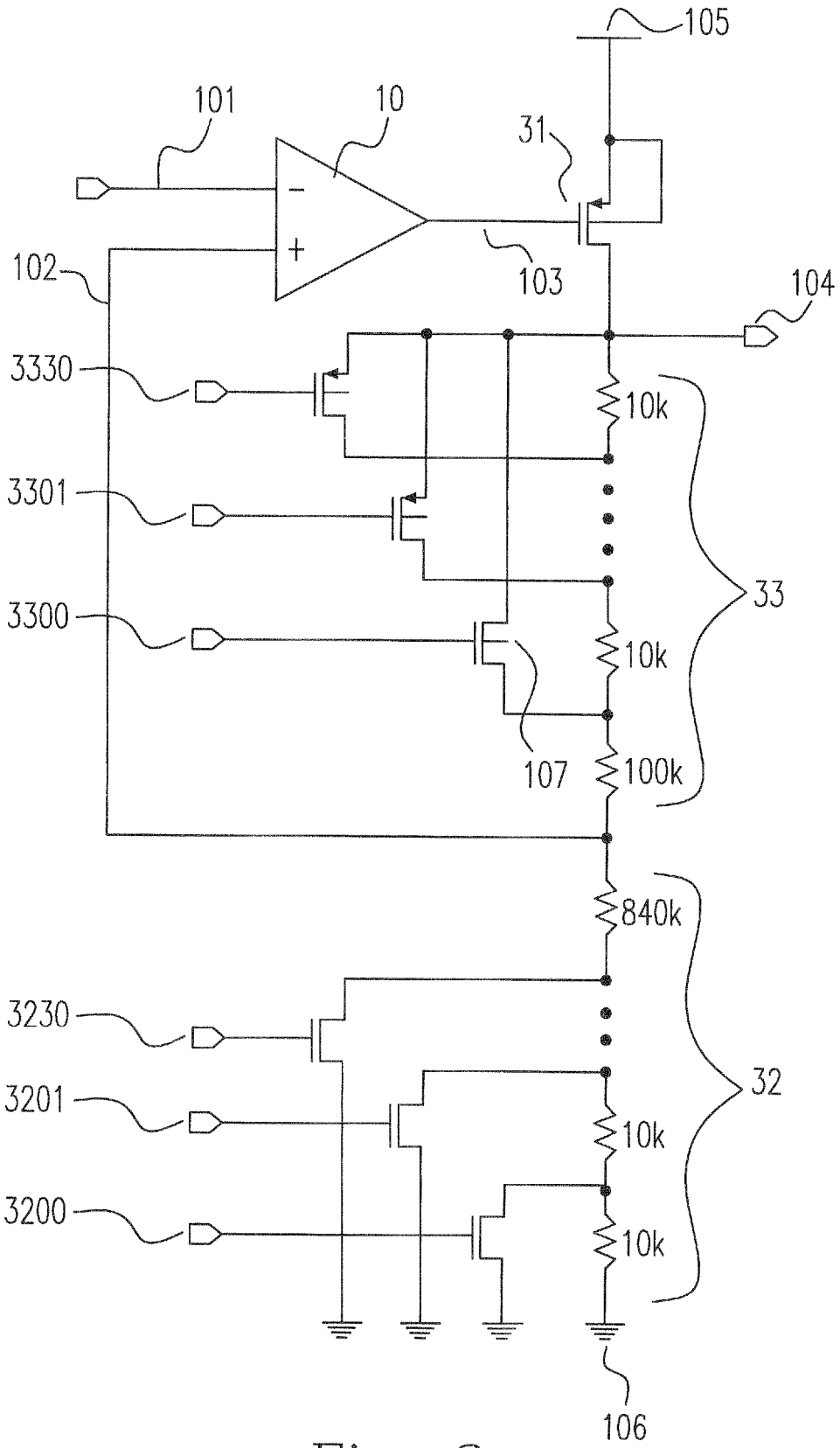
FIG. 3 is a diagram of a voltage buffer apparatus with a transistor array for modifying the resistor according to the preferred embodiment of the present invention.

In the other embodiment, FIG. 3 shows a voltage buffer apparatus with a transistor array 32, 33 for modifying the resistor magnitude of the present invention. The transistor array 32, 33 contains an arranged multiple n-channel MOSFET, wherein the source of each transistor is connected to ground, and the drain of each transistor is connected to different parts of one resistor array and an arranged multiple p-channel MOSFET, wherein the sources of every transistor are connected to the drain of a common-source transistor 31, the drain of each transistor is connected to different parts of another resistor array, and the substrate 107 of each transistor is connected to the output voltage 104.

That is the bandgap buffer for providing the bandgap buffer voltage to a chip, comprising an operational amplifier 10 having an output terminal 103, a first input terminal (non inverting), and a second input terminal (inverting) receiving an input voltage (input signal 101) and a first transistor (common-source transistor 31) having a control terminal (gate) connected to the output terminal 103 and a first terminal (drain) connected to the chip power source so as to provide the bandgap buffer voltage (the output voltage 104). And a switching array (transistor array 32, 33) includes (N+1) first resistors connected in series, each of which has a first and a second terminals, where N is a positive integer, a second resistor having a first and a second terminals, a third resistor having a first and a second terminals, (N+1) fourth resistors connected in series, each of which has a first and a second terminals, a first switching subarray with (N+1) second transistors (P-channel), each of which has a first and a second terminals, wherein all the second terminals (sources) of the (N+1) second transistors (P-channel) and the second terminal of the (N+1)th one of the (N+1) first resistors are connected to the first terminal (drain) of the first transistor (common-source transistor 31), the first terminal (drain) of the mth second transistor (P-channel) is connected to the first terminal of the mth one of the (N+1) first resistors, where m=1 . . . N+1, the first terminal of the second resistor is connected to the first input terminal (non inverting) of the operational amplifier, the second terminal of the second resistor is connected to the first terminal of the first one of the (N+1) first resistors, and the second terminal of the third resistor is connected to the first terminal of the second resistor, and a second switching subarray with (N+1) third transistors (N-channel), each of which has a first terminal (drain), and a second terminal (source) connected to a ground 106, wherein the first terminal (drain) of the last one of the (N+1) third transistors (N-channel) is connected to the first terminal of the third resistor, and the first terminal (drain) of the mth one of the (N+1) third transistors is connected to the second terminal of the mth one of the (N+1) fourth resistors.

When the circuit is starting to operate, only one of the n-channel MOSFETs 3200, 3201 . . . 3230 being on or none of them being on that can correspondingly have 32 different values of resistor, in a similar way, only one of the p-channel MOSFETs 3300, 3301 . . . 3330 being on or none of them being on that can also have 32 different values of resistor. Furthermore the values of two resistors generating from n-channel MOSFET being on and p-channel MOSFET being on that have a complementary way in arrangement order among the transistor array 32, 33 are summed as a constant, although they have different values according to the signal modulation of the transistor array 32, 33. The method of varying resistor can generate a feedback voltage 102 which has a magnitude between the compensating range ±150 mV of the input signal 101 with a 10 mV interval that are the same characteristics of the first embodiment and have the same consequence of compensating the varying input signal 101 by the feedback voltage 102 for generating a stabilized output voltage 104.

With the evolution of circuit topology in the preferred embodiment, the sum in values of above two resistors, i.e. the constant, is 1250K ohms according to the references cited in FIG. 3 and that is obvious much smaller than the illustrated 3130K ohms in the first embodiment. At the same time, due to the value of resistors being varying with the alteration of the input signal 101 and the magnitude of resistor referred to ground 106 being fixed during working in respect to the regularized output voltage 104, it is to say that the current of the common-source output stage will be remain unchanged.

In addition, the voltage buffer apparatus of the present invention contains a voltage process module in response to an input voltage (input signal 101) and a feedback signal (feedback voltage 102) for producing a bandgap buffer voltage (output voltage 104) as a stabilized voltage source to the next stage of the chip circuit. The main way is achieved through a symmetry circuit coupled to the voltage process module for producing the feedback signal and regulating the feedback signal in response to the input voltage. As a result of the invention of the voltage buffer apparatus, the signal processing in a low voltage bandgap circuit and the connected chip circuit in a bandgap system can be effectively integrated. And the purpose of providing a stabilized voltage source to the circuit without subjecting it to operating temperature fluctuations, other voltages, and environmental changes is accomplished.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims, which are to be accorded with the broadest interpretation so as to encompass all such modifications and similar structures. Therefore, the above description and illustration should not be taken as limiting the scope of the present invention which is defined by the appended claims.

What is claimed is:

1. A bandgap buffer for providing a bandgap buffer voltage to a chip, comprising:

an operational amplifier having an output terminal, a first input terminal, and a second input terminal receiving an input voltage;

a first transistor having a control terminal connected to the output terminal and a first terminal connected to the chip power source so as to provide the bandgap buffer voltage; and a switching array including:

(N+1) first resistors connected in series, each of which has a first and a second terminal, where N is a positive integer;

a second resistor having a first and a second terminal;

a third resistor having a first and a second terminal;

(N+1) fourth resistors connected in series, each of which has a first terminal and a second terminal;

a first switching subarray with (N+1) second transistors, each of which has a first and a second terminal, wherein all the second terminals of the (N+1) second transistors and the second terminal of the (N+1)th one of the (N+1) first resistors are directly connected to the first terminal of the first transistor, the first terminal of the mth second transistor is connected to the first terminal of the mth one of the (N+1) first resistors, where m=1 . . . N+1, the first terminal of the second resistor is connected to the first input terminal of the operational amplifier, the second terminal of the second resistor is connected to the first terminal of the first one of the (N+1) first resistors, and the second terminal of the third resistor is connected to the first terminal of the second resistor; and a second switching subarray with (N+1) third transistors, each of which has a first terminal, and a second terminal connected to a ground, wherein the first terminal of the last one of the (N+1) third transistors is connected to the first terminal of the third resistor, and the first terminal of the mth one of the (N+1) third transistors is connected to the second terminal of the mth one of the (N+1) fourth resistors.

2. The bandgap buffer according to claim 1, wherein the first transistor further comprises a second terminal receiving a power supply voltage, and each of the (N+1) second transistors and the (N+1) third transistors further has a control terminal receiving an external control signal.

3. The bandgap buffer according to claim 1, wherein the first transistor and each of the (N+1) second transistors are a P-type transistor and each of the (N+1) third transistors is an N-type transistor.

4. A bandgap buffer for providing a bandgap buffer voltage to a chip, comprising:

a voltage adjusting module having a first transistor with a first terminal, receiving an input voltage and a feedback signal, and regulating the input voltage according to the feedback signal so as to produce the bandgap buffer voltage; and a switching array coupled to the voltage adjusting module, and including:

(N+1) first resistors connected in series, each of which has a first terminal and a second terminal, where N is a positive integer;

a plurality of complementary switch sets, each of which has two complementary switches with two respective control terminals receiving two respective external control signals to enable a specific one of the plurality of complementary switch sets according to a reference range of the input voltage such that the enabled complementary switch set produces the feedback signal, wherein all the first ones of the two complementary switches have a first terminal and a second terminal, and all the second terminals of the first ones of the two complementary switches and the second terminal of the (N+1)th one of the (N+1) first resistors are directly connected to the first terminal of the first transistor.

5. The bandgap buffer according to claim 4, wherein the voltage adjusting module further comprises:

an operational amplifier having an output terminal, wherein the first transistor has a control terminal connected to the output terminal.

6. The bandgap buffer according to claim 5, wherein the switching array further comprises a first subarray with (N+1) P-type transistors and a second subarray with (N+1) N-type transistors.

7. The bandgap buffer according to claim 6, wherein the switching array further comprises:

a second resistor having a first and a second terminal;

a third resistor having a first and a second terminal; and (N+1) fourth resistors connected in series, each of which has a first and a second terminal, the first terminal of the first transistor is connected to the output terminal, (N+1) P-type transistors are the first ones of the two complementary switches, the (N+1) N-type transistors are the second ones of the two complementary switches, the second terminal of the (N+1)th one of the (N+1) first resistors are connected to the first terminal of the first transistor, the first terminal of the mth one of the (N+1) P-type transistors is connected to the first terminal of the mth one of the (N+1) first resistors, where m=1 . . . N+1, the first terminal of the second resistor is connected to the first input terminal of the operational amplifier, the second terminal of the second resistor is connected to the first terminal of the first one of the (N+1) first resistors, the second terminal of the third resistor is connected to the first terminal of the second resistor, each of the (N+1) N-type transistors has a first terminal, and a second terminal connected to a ground, the first terminal of the last one of the (N+1) N-type transistors is connected to the first terminal of the third resistor, and the first terminal of the mth one of the (N+1) N-type transistors is connected to the second terminal of the mth one of the (N+1) fourth resistors.

8. The bandgap buffer according to claim 4, wherein every complementary switch set comprises a P-type transistor and an N-type transistor.

9. A bandgap buffer, comprising:

a voltage processing module having a first transistor having a first terminal and a second terminal, and producing a bandgap buffer voltage in response to an input voltage and a feedback signal; and a symmetry circuit coupled to the voltage processing module, producing the feedback signal, regulating the feedback signal in response to the input voltage and comprising:

(N+1) first resistors connected in series, each of which has a first and a second terminal, where N is a positive integer;

a first subarray having plural P-type transistors, each of which has a first terminal directly connected to the first terminal of the first transistor and the second terminal of the (N+1)th one of the (N+1) first resistors; and a second subarray having plural N-type transistors, each of which has a first terminal connected to the ground and a second terminal coupled to the second terminal of the first transistor.

10. The bandgap buffer according to claim 9, wherein:

the voltage processing module includes an operational amplifier having an output terminal; and the first transistor has a control terminal connected to the output terminal.

11. The bandgap buffer according to claim 10, wherein a specific one of the plural P-type transistors is turned on for providing a first resistance, and another specific one of the plural N-type transistors of the second subarray is turned on for providing a second resistance, where both transistors are turned on in a complementary manner.

12. The bandgap buffer according to claim 11, wherein a sum of the first resistance and the second resistance is fixed though there are individual variations in the values of the first and the second resistances.

13. The bandgap buffer according to claim 12, further comprising a common source stage, wherein the second resistance is in variation with the input voltage that causes a constant current of the common source stage.

14. The bandgap buffer according to claim 10, wherein each of the plural P-type transistors is a P-type MOSFET, and the bandgap buffer voltage is bigger than a threshold voltage of the P-type MOSFET.

15. The bandgap buffer according to claim 9, wherein the operational amplifier further includes two input terminals, the feedback signal has a variation range of ±150 mV.

16. The bandgap buffer according to claim 9, wherein the bandgap buffer voltage is constant.

* * * * *